United States Patent [19]

Olsson

[11] Patent Number: 4,641,906

[45] Date of Patent: Feb. 10, 1987

[54] SHIELDED ELECTRICAL CONNECTOR

[75] Inventor: Billy E. Olsson, New Cumberland, Pa.

[73] Assignee: AMP Incorporated, Harrisburg, Pa.

[21] Appl. No.: 830,904

[22] Filed: Feb. 18, 1986

Related U.S. Application Data

[63] Continuation of Ser. No. 666,517, Oct. 30, 1984, abandoned.

[51] Int. Cl.[4] ..... H01R 4/66; H01R 13/58

[52] U.S. Cl. ..... 339/143 R; 339/107

[58] Field of Search ..... 339/103 R, 103 B, 103 C, 339/103 M, 107, 143 R, 138, 141, 208

[56] References Cited

U.S. PATENT DOCUMENTS

| | | | |
|---|---|---|---|
| 3,281,756 | 10/1966 | O'Keefe et al. | 339/143 R |
| 3,771,104 | 11/1973 | Clark | 339/198 G |
| 3,848,951 | 11/1974 | Michaels et al. | 339/91 R |
| 4,018,979 | 4/1977 | Young | 339/143 R |
| 4,131,332 | 12/1978 | Hogendobler et al. | 339/143 R |
| 4,310,213 | 1/1982 | Ketterolf, Jr. et al. | 339/103 M |
| 4,449,778 | 5/1984 | Lane | 339/107 |
| 4,508,415 | 4/1985 | Bunnell | 339/143 R |

*Primary Examiner*—Gil Weidenfeld
*Assistant Examiner*—Gary F. Paumen
*Attorney, Agent, or Firm*—Eric J. Groen; F. Brice Faller

[57] ABSTRACT

Fully shielded electrical connector for shielded cable comprises a terminal housing, upper and lower ground shields, and upper and lower insulative cover parts. Lower ground shield has flanges flanking cable receiving opening in rearwall which fit flushly in cable receiving opening in rearwall of lower cover. Inserter member has cable receiving aperture therethrough which opens in dovetail slot which engages dovetail flanges on rearwall of lower housing to prevent overstressing openings in lower shield and housing when cable with contact ferrule is inserted therein.

19 Claims, 15 Drawing Figures

SHIELDED ELECTRICAL CONNECTOR

This application is a continuation of application Ser. No. 666,517 filed 10-30-84 now abandoned.

BACKGROUND OF THE INVENTION

The present invention relates to a shielded electrical connector.

U.S. Pat. No. 4,449,778 discloses a shielded electrical connector of the type having a front, mating portion and a rear, cable connecting portion, the connector comprising a terminal housing, upper and lower ground shields, and upper and lower insulative cover parts. The lower ground shield and lower cover part each have a panel with a wall upstanding therefrom, the walls each having a cable receiving opening therein which opens away from the respective panels, the openings being aligned for reception of a cable when the lower ground shield is assembled inside the lower cover part.

The opening in the lower shield member is not reinforced against overstress and, further, the insulated conductors within the shielded cable may rearrange to reduce the contact force on the shield. The braid must be wrapped back against a ferrule thereon, limiting dimensional control.

SUMMARY OF THE INVENTION

According to the invention, therefore, the cable receiving opening in the upstanding wall of the lower shield is flanked by a pair of integrally formed flanges which fit substantially flushly into the cable receiving opening in the upstanding wall of the lower cover part. The lower cover part has a pair of parallel flanges flanking the opening therein on the outside surface of the upstanding wall thereof, the flanges being collectively profiled as a dovetail. The assembly further comprises an inserter member having an aperture therethrough, the aperture opening in a dovetail slot on a mating face of the inserter member, the dovetail slot being profiled to engage the dovetail flanges on the outer wall of the lower cover part by movement of the inserter member perpendicularly toward the plane of the panel of the lower cover part. The assembly further comprises a metal contact ferrule profiled to fit between the individual conductors and the shield of a cable. Upon assembling the lower ground shield to the lower cover part, assembling the cable through the inserter member, stripping the outer insulation from the end protruding from the mating face to expose the cable, and inserting the ferrule between the individual conductors and the exposed cable shield, the exposed cable shield can be forced between the flanges of the lower shield when the dovetail slot in the inserter is mated with the dovetail flanges on the lower cover part.

The inventive connector provides the advantage of assured contact integrity between the lower shield and the cable shield, which upon mating with a complementary connector assures continuity of ground between shields of respective cables.

An embodiment of the invention will now be described in greater detail with reference to the appended figures.

DETAILED DESCRIPTION OF THE PREFERRED EMBODIMENT

Figure 1:
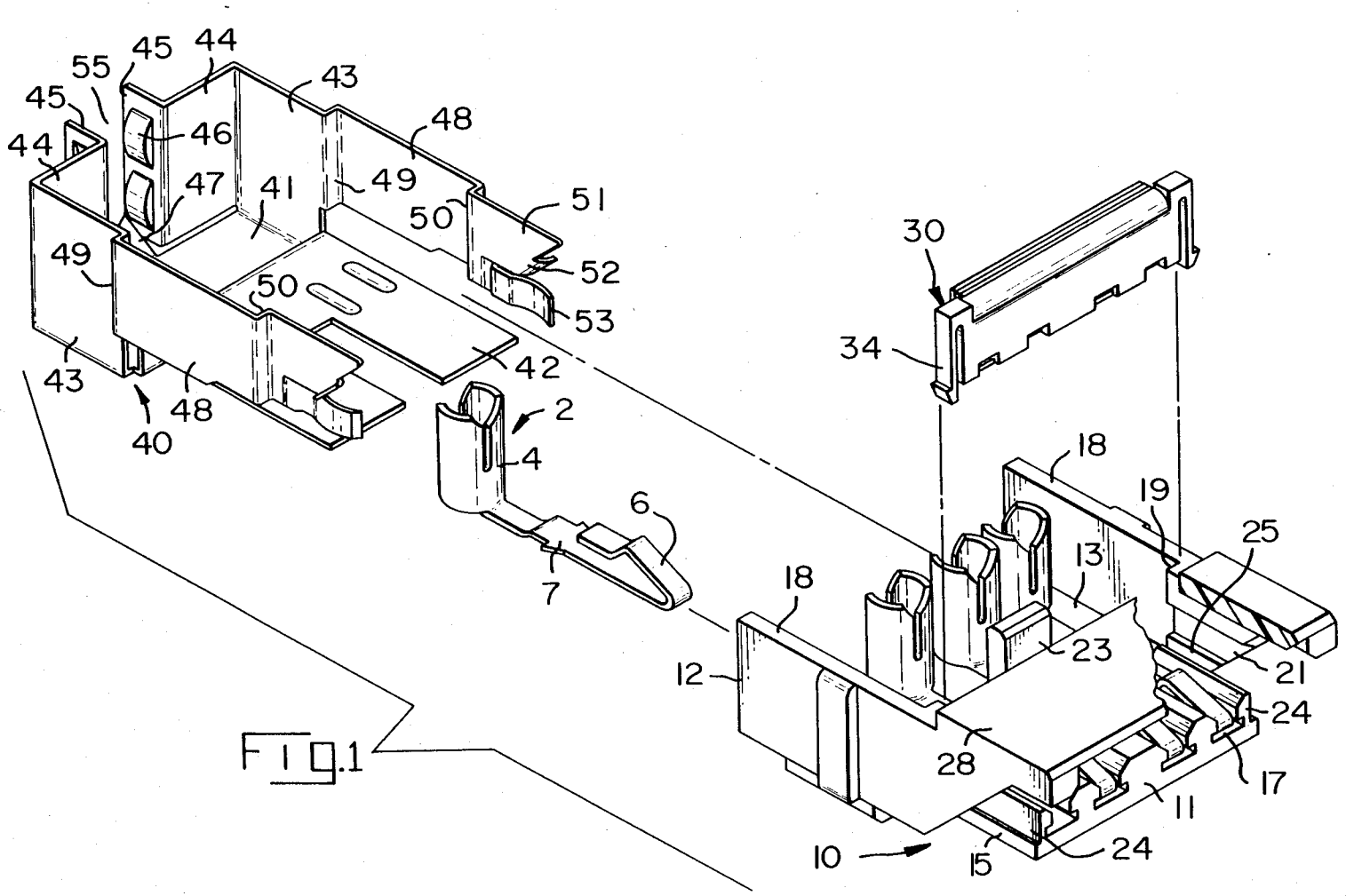
FIG. 1 is an exploded perspective of the housing, terminals, lower shield, and shunt assembly.

FIG. 1 shows a terminal housing 10 with which the assembly sequence begins. The housing 10 has a terminal support platform 13 extending from a front end 11 to a rear end 12 where terminals 2 are received. Each terminal 2 has a wire barrel 4, a mating tongue 6, and a base portion 7 extending therebetween; the base portion 7 is received in the respective channel 17 in the platform 13. The platform is flanked by sidewalls 18 upstanding therefrom, which sidewalls have rearward facing shoulders 19 on respective inside faces thereof and shielding channels 21 extending forward from the shoulders 19. Partitions 24 flank the inside faces of the sidewalls 18 forward of shoulders 19 and define slots 25 below channels 21. A hood 28 bridges the sidewalls 18 at this end. Shunt assembly 30 is shown poised for reception between shoulders 19 and a post 23 upstanding from the platform 13 between the two central channels 17.

Lower shield 40 comprises a base panel 41 from which integrally formed forward contact portion 42 extends and sidewalls 43 upstand. Rearwall portions 44 are formed from respective sidewalls 43 to flank base panel 41 and define a cable receiving opening 55 therebetween. Each rearwall portion 44 is formed with a flange 45 flanking opening 55, each flange 45 being formed with detents 46. A resilient tongue 47 extends from the panel 41 into opening 55. Forward wings 48 are formed from respective sidewalls 43 at respective first bends 49 which define rearward facing shoulders on opposed surfaces thereof. The wings 43 are also formed with second bends 50 defining forward facing shoulders on opposed surfaces thereof. A mating flange 51 and a resilient tongue 53 extend forwardly from each shoulder 50; the flange 51 has an outwardly curled lip 52 for mating with the tongue of a like connector.

Figure 2:
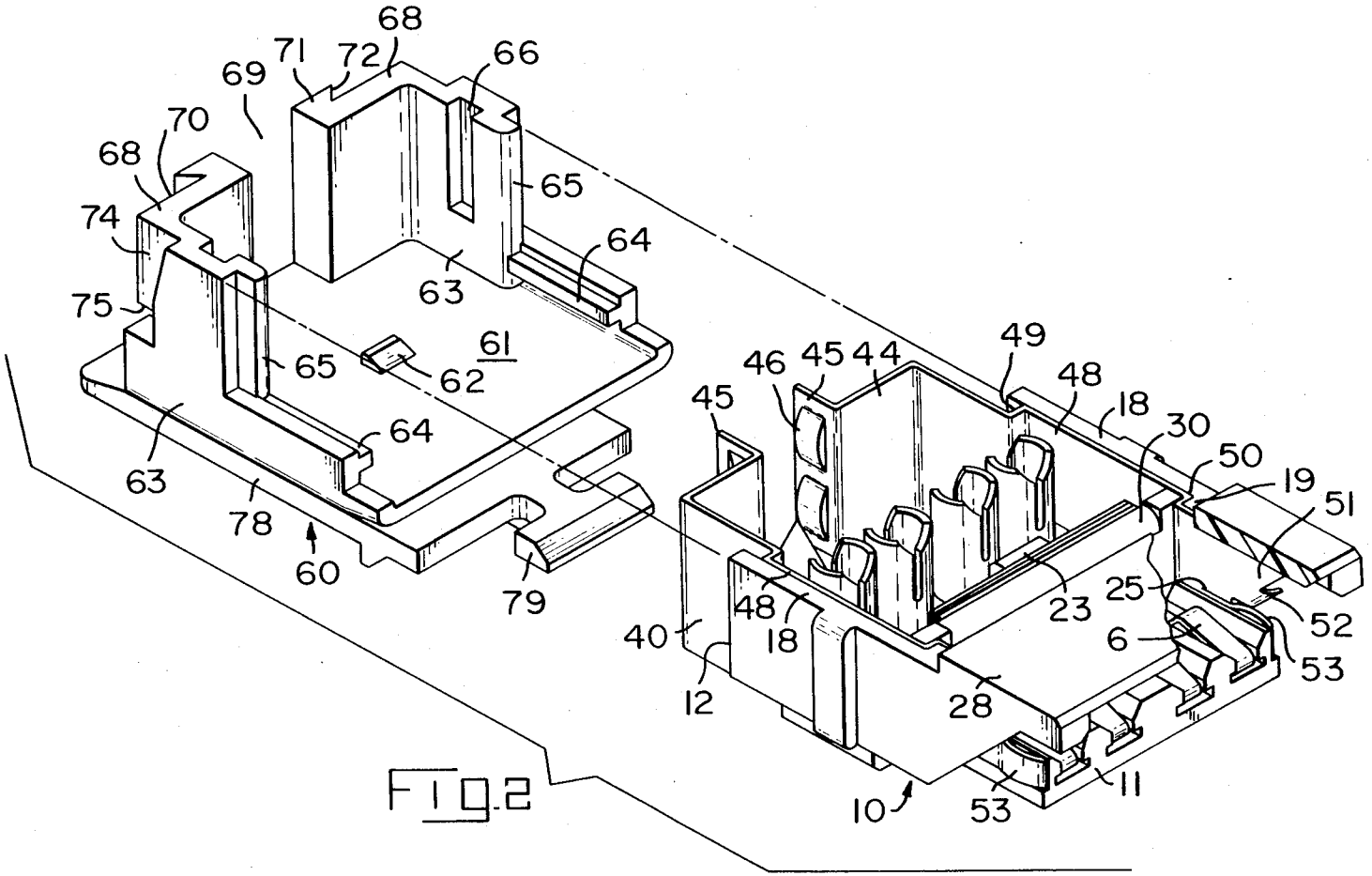
FIG. 2 is a perspective of the lower cover exploded from the assembled housing and lower shield.

FIG. 2 shows the lower shield 40 assembled to housing 10; forward wings 48 are flush against inside surfaces of sidewalls 18 in the housing and forward facing shoulders 50 on the shield abut rearward facing shoulders 19 on the housing. Tongues 53 lie in slots 25 with the flange 51 offset thereabove. The channel 21 (FIG. 1) allows passage of lip 52 therethrough during assembly. The shunt assembly 30 is latchably emplaced after the shield 40 is assembled to housing 10.

Figure 3:
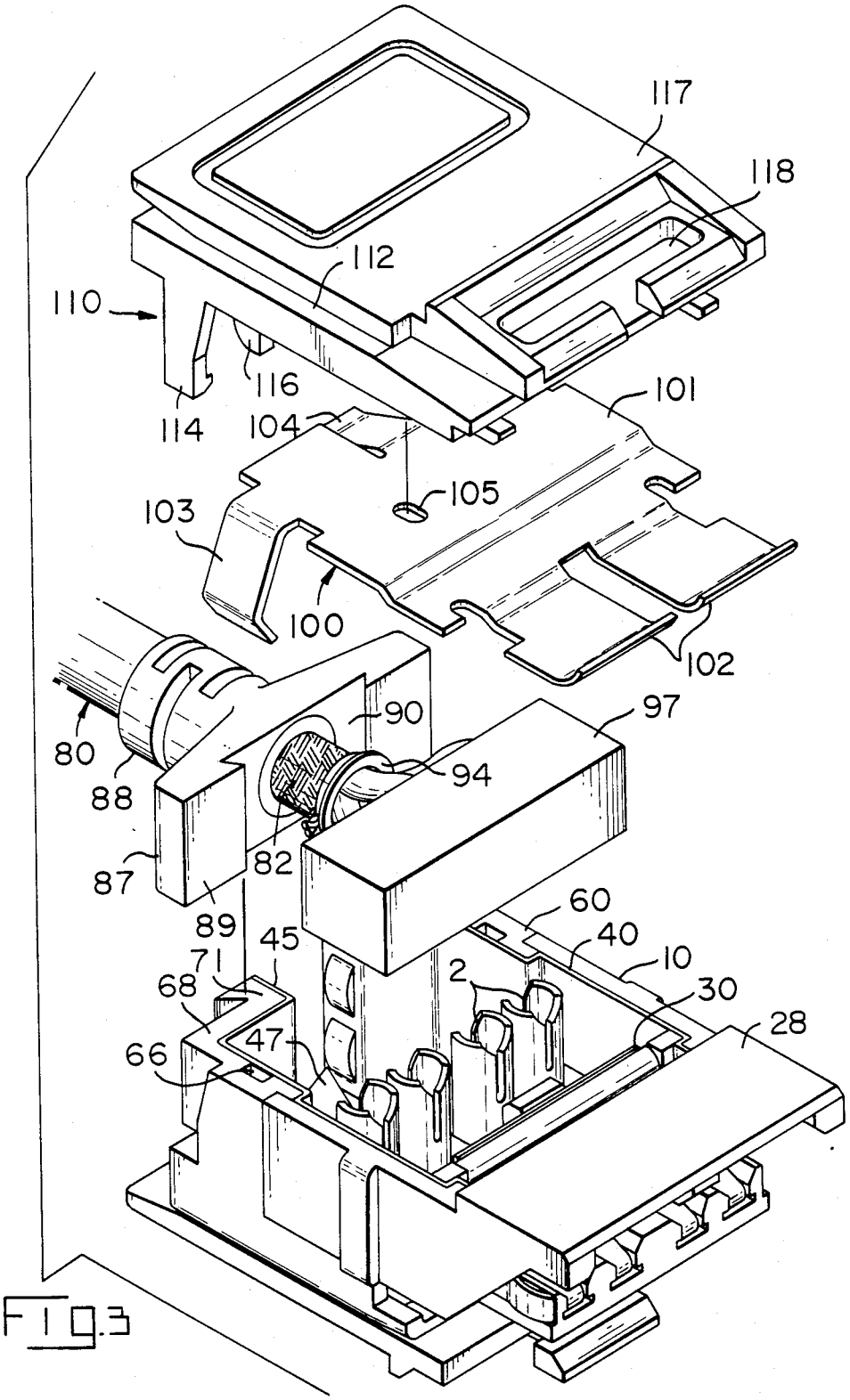
FIG. 3 is a perspective of the upper cover, upper shield, and inserter assembly exploded from the assembled housing, lower shield, and lower cover.

The lower cover 60 comprises a base panel 61 having integrally molded sidewalls 63 and rearwalls 68 upstanding therefrom. A latch 62 upstanding from the center of base 61 serves to retain the cover 60 with housing 10 (FIG. 7B). Sidewalls 63 have respective horizontal mating ribs 64 extending forwardly therefrom for mating with housing 10 (FIG. 7C) and vertical mating ribs 65 for reception between rear face 12 of housing 10 and shoulder 49 of lower shield 40. The rearwalls 68 define a cable opening 69 therebetween and have respective flanges 71 extending from outside surfaces 70 and flanking opening 69. The flanges 72 taken together are profiled as a dovetail intersected by opening 69. Notches 74 are formed at the interstice of each sidewall/rearwall pair, the notches 74 each having a shoulder 75 therein for retention of the upper cover 110 (FIG. 3). The latch arm 78 is molded with a T-member 79 for mating with a complementary connector.

FIG. 3 depicts the lower cover 60 assembled to the lower shield 40 and housing 10. The flanges 45 fit flushly against flanges 71 on rearwalls 68. The inserter assembly, shown in greater detail in FIGS. 6A and 6B, comprises cable 80, inserter member 87, and stuffer 97. The inserter member 87 comprises a rearward gripping portion 88 and a mating flange 89 which is profiled with a dovetail slot 90 for receiving the dovetail ridges 72 on the lower cover 60. A contact ferrule 94 is fit between individual insulated conductors 81 and braided shield 82 to insure good grounding contact between flanges 45 and the braid 82; detents 46 serve to retain ferrule 94.

An upper shield 100 comprises a base panel 101, forward contact tongues 102, and resilient side members 103 which are received against inside faces of respective sidewalls 43 on lower cover 40. Resilient tongue 104, like tongue 47 below, serves to contact braid 82. Upper cover 110 comprises a panel portion 112, lock arms 114, and a latch arm 117 having a T-slot 118 for retention with a complementary connector. Aligning posts 116 are received in channels 66; the rounded surfaces of posts 116 serve to cam the cover 110 forward to fit snugly against hood 28. The upper shield 100 is assembled to upper cover 110 by staking plastic studs in through holes 105 and assembled to lower cover 60 and housing 10 after inserter 87 and stuffer 97 are applied thereto by latching arms 114 with shoulders 75 in notches 74.

Figure 4:
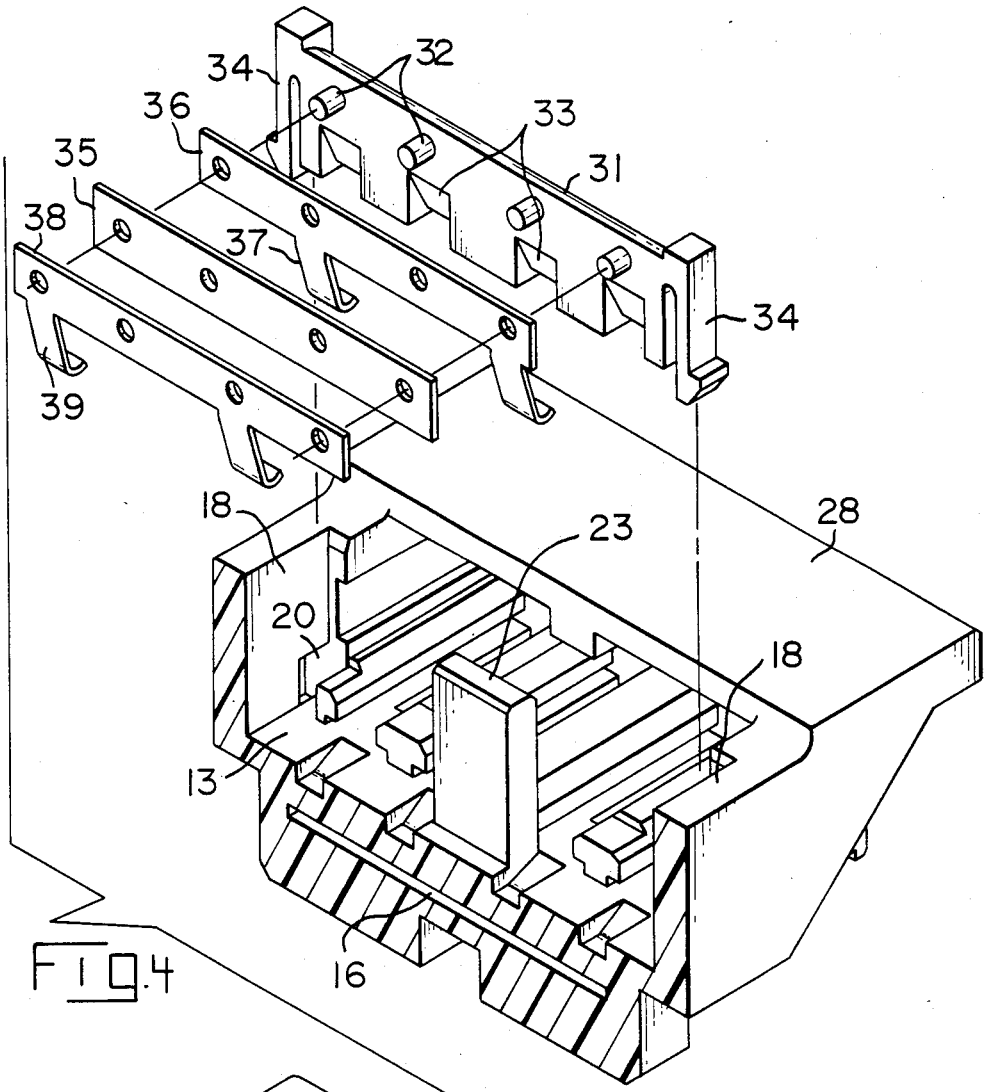
FIG. 4 is an exploded perspective of the shunt assembly and a sectioned portion of the housing.

FIG. 4 shows the exploded components of shunt assembly 30, which comprises a dielectric carrier 31, shunt members 36, 38 for bridging alternative terminals, and a dielectric spacer 35 therebetween. The carrier 31 has staking pegs 32 for fixing members 36, 38 thereto and channels 33 which permit flexure of the shunt contacts 37, 39. Latches 34 cooperate with apertures 20 in sidewalls 18 of housing 10 to retain the assembly 30 (FIG. 1) which is positioned between shoulders 19 and post 23. Note slot 16 in platform 13, which slot receives the forward contact portions 42 of lower shield 40 (FIG. 1).

Figure 5:
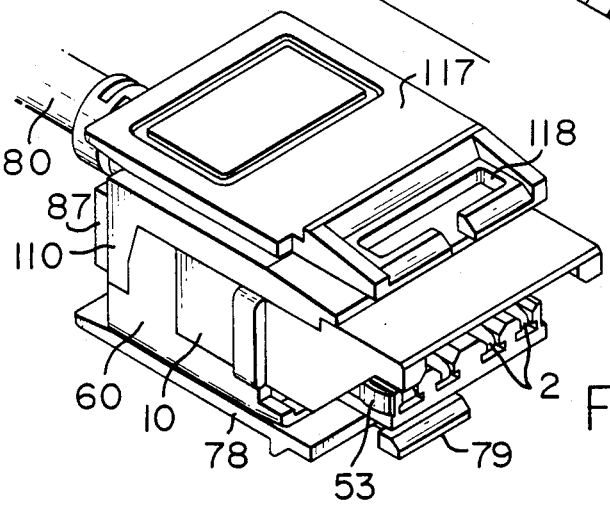
FIG. 5 is a perspective of the assembled connector.

The assembled connector is shown in FIG. 5; like the connector disclosed in U.S. Pat. No. 4,449,778, it is an hermaphroditic connector designed to mate with a like connector inverted so that T-bars 79 mate with T-slots 118. Further, the connector of the present invention is designed to mate with a connector of the type disclosed in U.S. Pat. No. 4,449,778; the resilient tongues 53, which mate with respective flanges 51 in a like connector, do not preclude mating with the prior art connector.

Figure 6A:
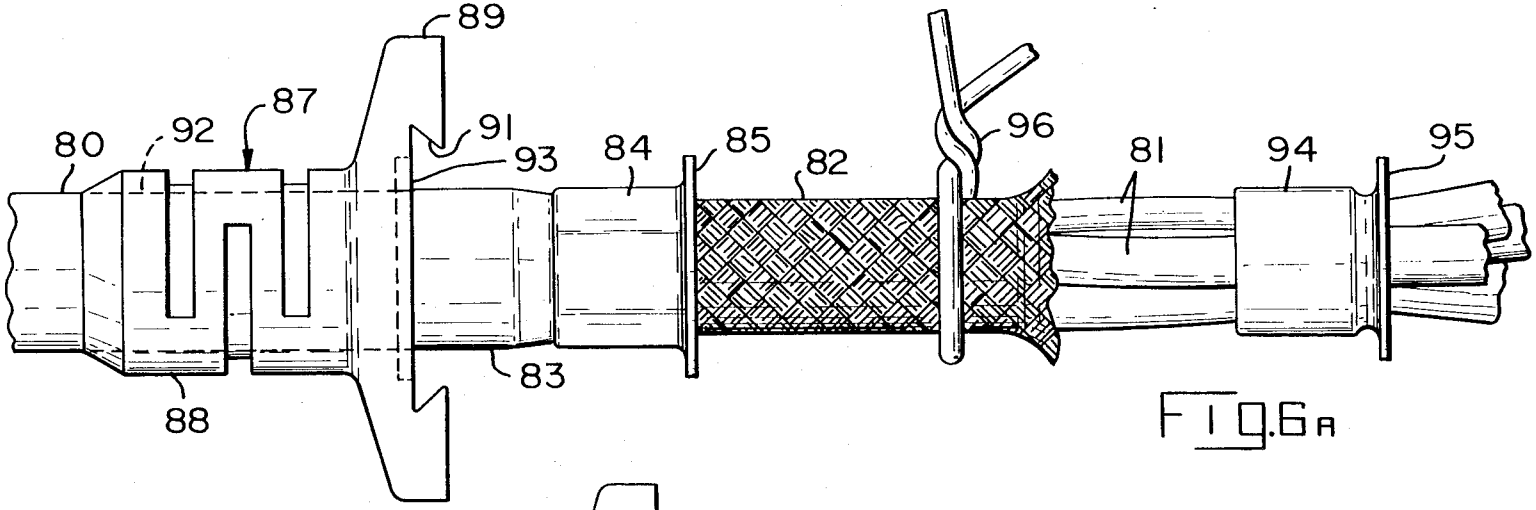
FIG. 6A is a plan view of the assembled cable, inserter, and strain relief ferrule before assembling the contact ferrule and clamp.
Figure 6B:
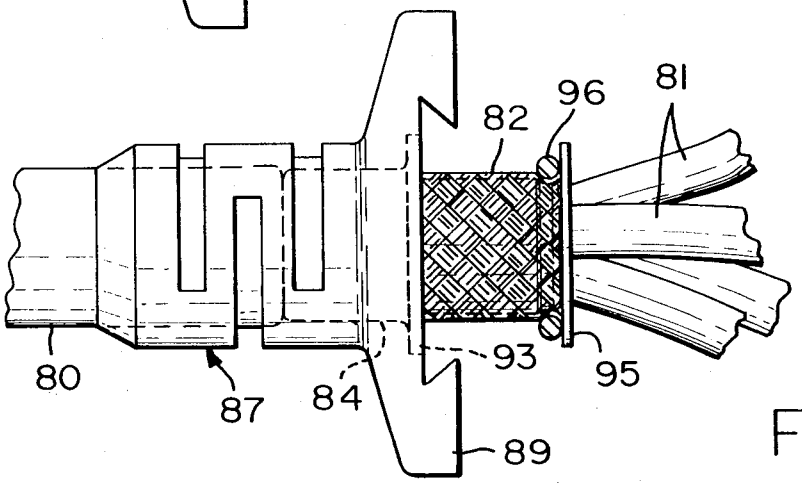
FIG. 6B is a plan view of the contact ferrule and clamp assembled to the cable.

FIG. 6A shows the inserter member having cable 80 fed through axial aperture 92 therein and emerging from mating flange 89. The insulation 83 is stripped to expose braid 82 and a strain relief ferrule 84 is crimped to the insulation 83 adjacent the exposed braid. Flange 85 on ferrule 84 is profiled to nest in countersink 93 in mating flange 89, as shown in FIG. 6B, thus preventing strain on the conductor terminations when axial force is applied on cable 80. Referring again to FIG. 5A, the contact ferrule 94 is shown loosely fit on exposed conductors 81. This is subsequently fit concentrically within braid 82, the clamp 96 is applied, and the braid trimmed as shown in FIG. 6B.

Figure 7A:
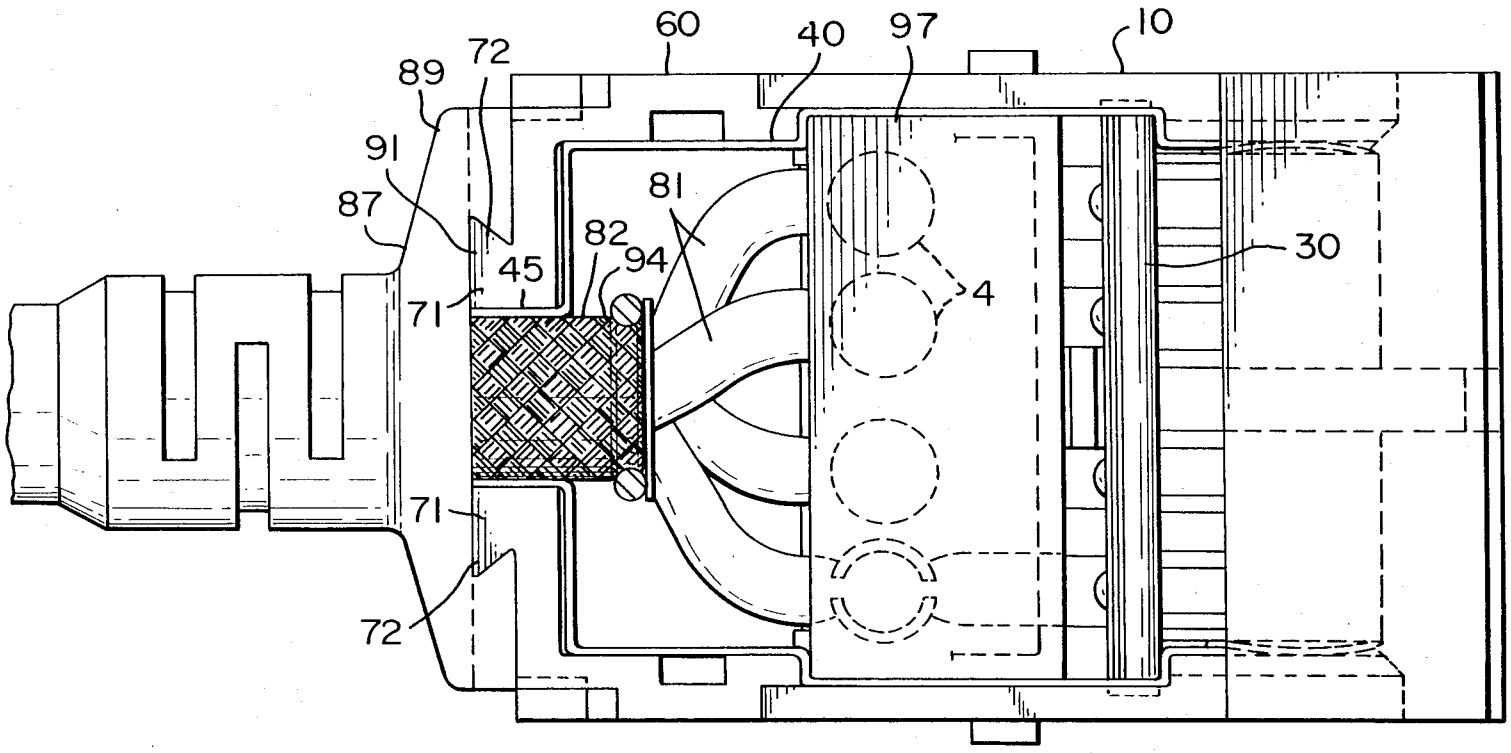
FIG. 7A is a plan view of the assembled connector.
Figure 7B:
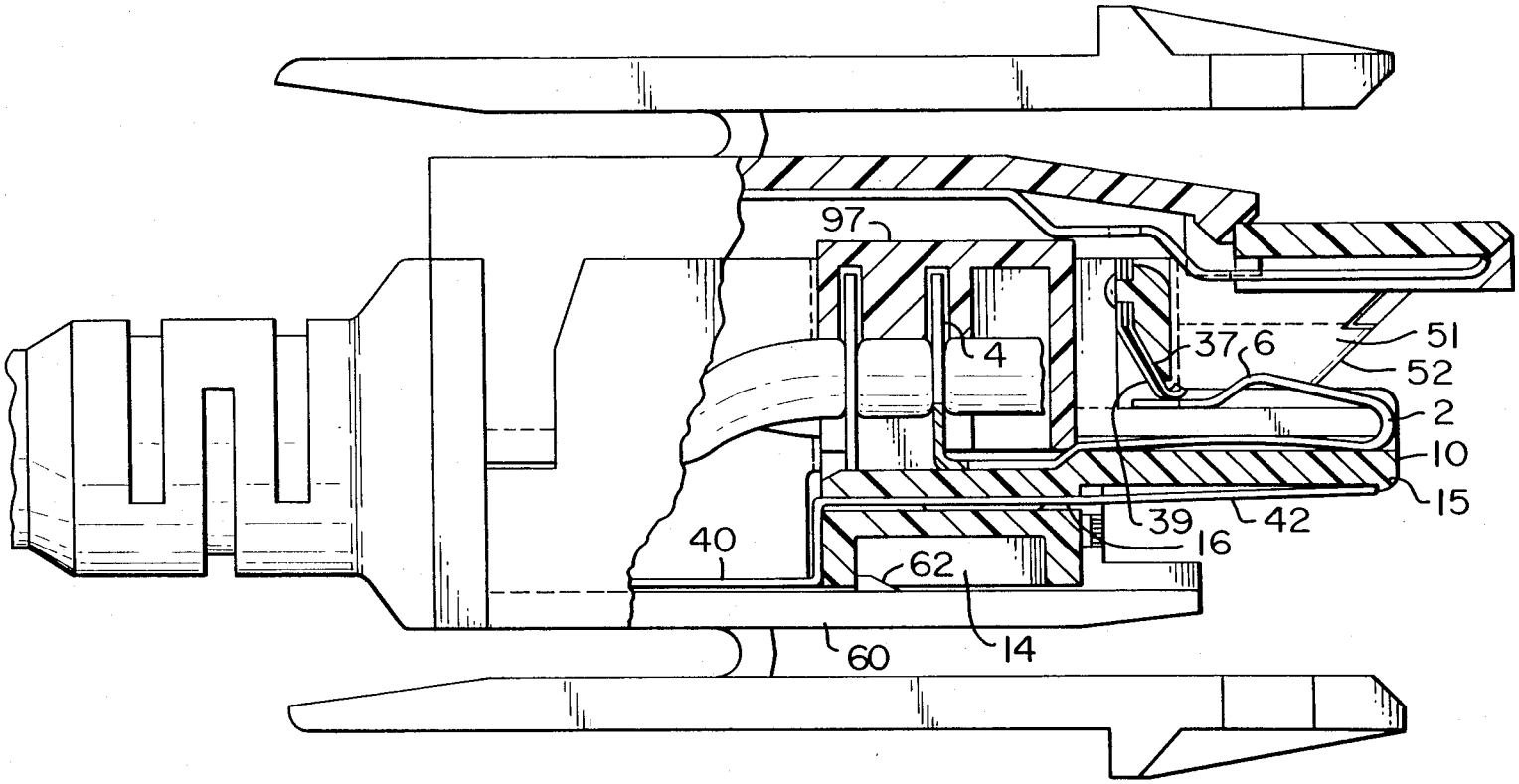
FIG. 7B is a side view of the assembled connector.

FIG. 7A is a plan view of the assembled connector with the upper cover removed. The stuffer 97 has been used to force the individual insulated conductors 81 into the wire barrels 4 of the terminals 2 in conventional fashion. The shunt assembly 30 is emplaced to electrically connect alternate tongues 6 as described in U.S. patent application Ser. No. 597,862, filed Apr. 9, 1984. The dovetail slot 91 on mating flange 89 of inserter member 87 is engaged with dovetail flanges 72, offering a major advantage of the inventive connector, to wit, compressive force is maintained on the contact ferrule 94 within braid 82. This assures that the electrical contact between the braid 82 and lower ground shield 40 will be maintained, while contact forces tend to relax in known prior art arrangements.

FIG. 7B is a partial side section view of the assembled connector. This view details the cooperation between housing 10, lower shield 40, and lower cover part 60. The housing 10 has a terminal support platform 13 with a forward extension 15 and an opposed bottom recess 14. A shield slot 16 extends through the housing 10 and receives forward contact portions 42 of lower shield 40 therethrough to lie below extension 15. The contact portions 42 so emplaced provide mating surfaces for contact tongues 102 of an upper shield 100 in a complementary connector. The lower cover part 60 protects the base panel 41 of lower shield 40 and is held in place by cooperation of latch 62 in recess 14.

Figure 7C:
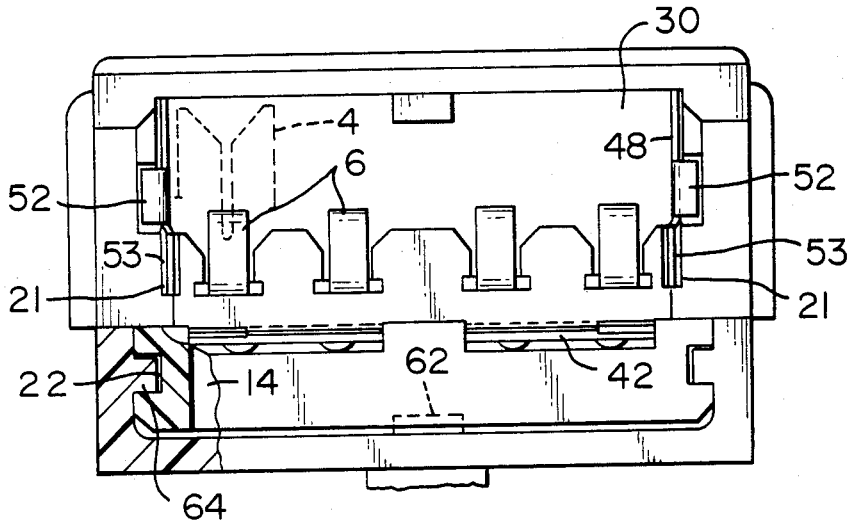
FIG. 7C is a mating end view of the assembled connector without the top cover.

FIG. 7C is an end view showing the cooperation between ribs 64 on lower cover 60 and channels 22 in housing 10 which serves to support the two parts in mated condition. The forward wings 48 of lower shield 40 are shown emplaced against sidewalls 18 with the tongues 53 in respective slots 25 and extending therebeyond (FIG. 2) for mating against the flange 51 of a like shield in a complementary connector. The lip 52 is formed outward to permit mating without interference.

Figure 8:
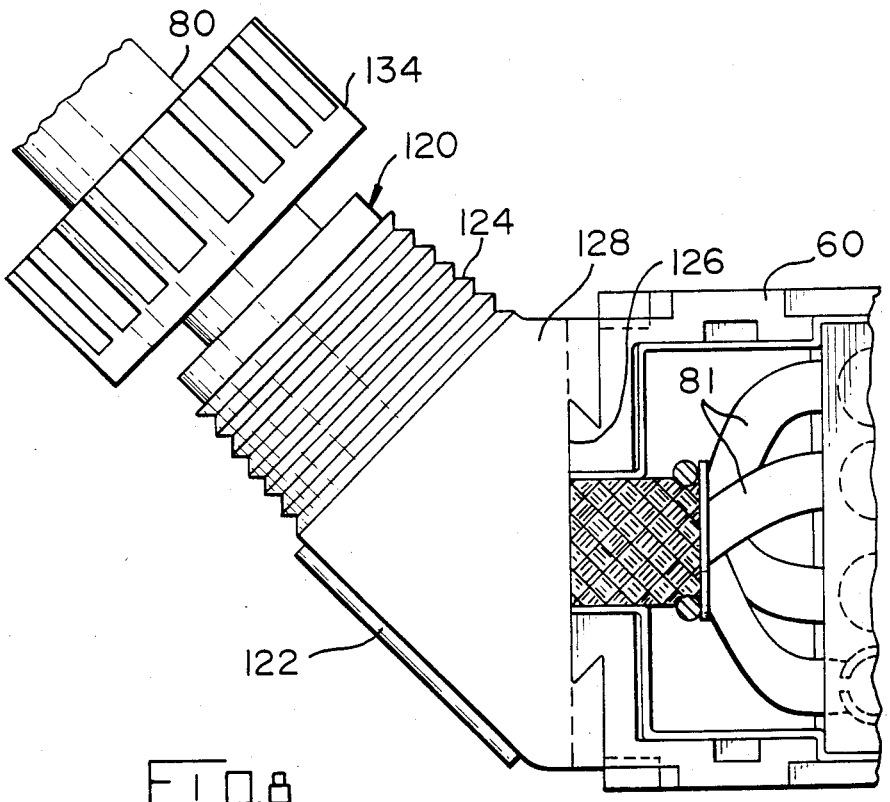
FIG. 8 is a plan view of an alternative inserter as assembled to the cable and lower cover.
Figure 9A:
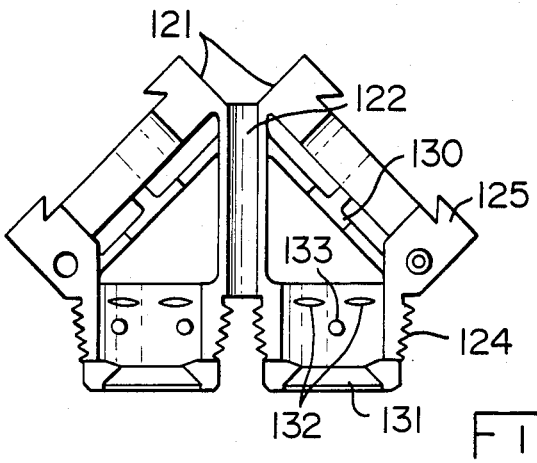
FIG. 9A to 9D are views of the alternative inserter halves.
Figure 9B:
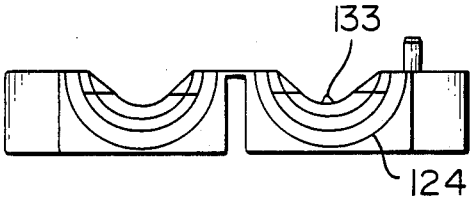
Figure 9C:
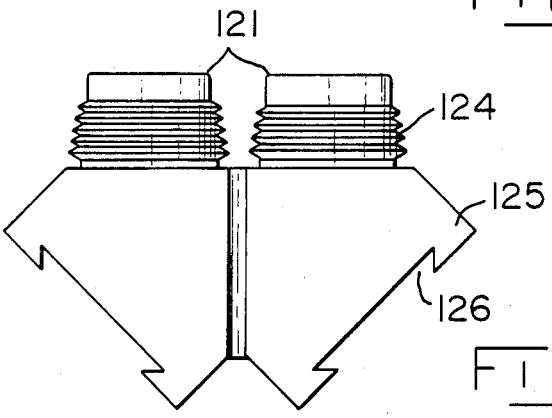
Figure 9D:
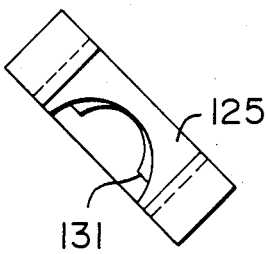

FIG. 8 depicts an alternative inserter 120 which provides for terminating the cable 80 at 45 degrees to the lower cover part 60. The inserter 120 comprises a threaded portion 124 which receives an internally threaded compression cap 134 and a mating portion 125 having a dovetail slot 126 which mates with flanges 72 as previously described. This inserter 120 can be inverted to permit termination of cable 80 at a second orientation 45 degrees to the lower cover part. Cable clamping to provide strain relief for termination of conductors 81 is provided by applying compression nut to threaded portion 124.

Referring to FIGS. 9A to 9D, the alternative inserter 120 is conveniently molded in two halves 121 connected by a hinge 122. Each half 121 has a cable receiving bore portion 128 which in cooperation with the other bore portion forms a passage through the assembled inserter 120. Each bore portion is profiled with flanges 130, 131, ridges 132, and a spike 133 for progressively bearing on the outer jacket of cable 80 as a nut 134 (FIG. 8) is threaded into position. This arrangement eliminates the need for a strain relief ferrule 84 as previously described.

I claim:

1. A shielded electrical connector assembly of the type having a front, mating portion and a rear cable connecting portion, the assembly comprising a terminal housing, upper and lower ground shields, and upper and lower insulative cover parts, the lower ground shield and lower cover part each having a panel with a wall upstanding therefrom, said walls each having a cable receiving opening therein which opens away from the respective panels, the openings being aligned for reception of a cable when the lower ground shield is assembled inside the lower cover part, characterized in that:

the cable receiving opening in the upstanding wall of the lower shield is flanked by a pair of integrally formed flanges profiled to receive a shielding braid of said cable, the flanges fitting substantially flushly into the cable receiving opening in the upstanding wall of the lower cover part, the lower cover part having a pair of parallel flanges flanking the opening therein on the outside surface of the upstanding wall thereof, said lower cover flanges being collectively profiled as a dovetail, said assembly further comprising an inserter member having an axial aperture therethrough for receiving the shielded cable therethrough, said aperture opening in a dovetail slot on a mating face of said inserter member, said dovetail slot being profiled to engage the dovetail flanges on said outer wall of said lower cover part by movement of said inserter member perpendicularly toward the plane of the panel of said lower cover part, said assembly further comprising a metal contact ferrule slidably receivable over the individual conductors and beneath the shield of the cable, the ferrule profiled to create a compressive fit between the flanges of the lower shield and the cable shield, the dovetail slot and dovetail flanges being profiled to maintain the compression between the flanges of the lower shield and the shield of the cable, whereby, upon assembling said lower ground shield to said lower cover part, assembling said cable through said inserter member, stripping the outer insulation from the end of the cable protruding from the mating face to expose the cable shield, and inserting the ferrule between the individual conductors and the exposed cable shield, the exposed cable shield can be forced between the flanges of the lower shield when the dovetail slot in the inserter is mated with the dovetail flanges on the lower cover part.

2. The assembly of claim 1 characterized in that the assembly further comprises a strain relief ferrule which is crimped to the outer insulation after assembling the cable through the aperture in the inserter, the strain relief ferrule having a flange which is located toward the end of the outer insulation, the flange being profiled to prevent pulling the strain relief ferrule through the aperture, whereby axial forces on the cable will be transmitted through the inserter member to the lower cover member.

3. The assembly of claim 2 characterized in that the aperture is countersunk to receive the flange on the strain relief ferrule therein.

4. The assembly of claim 1 characterized in that the flanges on the lower shield member are each formed with a pair of resilient detents formed into the opening and directly opposing the detents of the opposite flange, the detents serving to position the contact ferrule therebetween.

5. The assembly of claim 1 characterized in that the axial aperture through the inserter member is profiled to bend the cable, the dovetail slot in the mating face being profiled to mate with the dovetail flanges on the lower cover part in two orientations whereby the cable may approach the connector assembly in either of two directions.

6. A shielded electrical connector, comprising:

a terminal housing having a front mating face, a terminal support floor, sidewalls and a rearwall upstanding from said support floor, and a cable receiving portion in one of said walls defined by a vertically extending opening therein and opposed flanges flanking the opening thereof;

a shield member disposed within said terminal housing, said shield member having side wall portions and a rear wall portion adjacent to the respective side walls and rear wall of said terminal housing, the shield member further comprising a pair of parallel flanges profiled to be received in said cable receiving opening adjacent to the opposed flanges, the shield flanges profiled to receive a shielding braid of a shielded cable therein;

a metal ferrule slidably receivable beneath the shielding braid of the cable, the ferrule profiled such that the shielding braid is received between the flanges of the shield member to create a compressive force between the flanges of the lower shield member and the shielding braid; and an inserter member having means to receive the shielded cable therethrough, said receiving means opening into a profiled slot on a mating face of said inserter member, said profiled slot being receivable over the profiled flanges which flank the opposed flanges of said cable receiving opening and profiled to resist the outward deflection of said opposed flanges when the shielding braid and ferrule are forced between said shield flanges thereby maintaining the electrical contact force between the shielding braid and the shield flanges.

7. The connector of claim 6 wherein the receiving means in the inserter member comprises an axial aperture extending through the inserter member.

8. The connector of claim 7 wherein the profiled slot comprises a slot profiled as a dovetail and oriented in a transverse direction to that of the axial aperture.

9. The connector of claim 8 wherein the flanges are profiled as dovetails receivable within the dovetail slot of the inserter member.

10. The connector of claim 6 wherein the cable receiving portion of the terminal housing is located in the rear wall.

11. The connector of claim 6 wherein the ferrule is profiled to be received between the conductors of the shielded cable and the shielding braid of the shielded cable.

12. The connector of claim 6 wherein the ferrule is profiled to be received between the conductors of the shielded cable and the shielding braid of the shielded cable.

13. The connector of claim 12 wherein the detent means comprises two stamped out semi-circular portions on each shielding flange in opposed relation with the other two portions, to trap between themselves the shielding braid.

14. The connector of claim 13 wherein the detent means comprises two stamped out semi-circular portions on each shielding flange in opposed relation with the other two portions, to trap between themselves the shielding braid.

15. A shielded electrical connector for receiving a shielded cable having a metal ferrule backing the shielding thereof, and for electrically terminating conductors within the shielded cable to electrical terminals within a housing of the connector, the electrical terminals including resilient contact portions for contacting terminal portions of a mating connector, the connector being characterized in that:

the connector includes a connector body having a floor and walls upstanding therefrom, one of said walls including a cable shield opening extending through the wall and through profiled flanges which flank the opening, the opening defining parallel and opposed surfaces; a shielding member having a floor and walls upstanding therefrom profiled to be received in the connector body with the walls and floor of the shielding member substantially adjacent to the respective walls and floor of the connector body, the shielding member further comprising stamped and formed plate members integral with the shielding member being profiled to lie within the cable opening adjacent to the parallel and opposed surfaces, the shielding plate members profiled to receive the shielding backed by the ferrule in an interference fit; and an inserter member having means to receive the shielded cable therethrough, the cable receiving means opening into a profiled slot receivable over the profiled flanges, the cable opening, the plate members and the inserter member cooperatively profiled such that upon moving the inserter member with a shielded cable therein towards the cable opening, the profiled slot engages the profiled flanges prior to the shielded cable contacting the plate members, such that upon continued movement of the inserter towards the cable opening, the shielded cable contacts the plate members, and the profiled slot over the profiled flanges resists the outward deflection of the cable receiving opening, maintains the interference fit between the shielding plate members and the shielded cable and ensures a contact force between the cable shield and the shielding plate members.

16. The connector of claim 14 wherein the terminals include an insulation displacement portion for laterally receiving a wire therein.

17. The connector of claim 16 wherein the cable receiving opening opens upwardly away from the floor of the body.

18. The connector of claim 17 further comprising a stuffer member profiled to align the wires to be terminated in correspondence with the insulation displacement portions of the terminals, such that one lateral movement of the inserter member and stuffer member towards the connector body inserts the shield of the cable within the shielding plates and terminates the conductors of the wires in the insulation displacement portions of the terminals.

19. The connector of claim 14 wherein the opening in the inserter member comprises an axial aperture therethrough.

* * * * *